United States Patent [19]

Berna et al.

[11] 4,254,592

[45] Mar. 10, 1981

[54] BARREL-TYPE SHOT BLASTING MACHINE

[75] Inventors: Emil Berna; Sergej Toedtli, both of Schaffhausen, Switzerland

[73] Assignee: Georg Fischer AG, Switzerland

[21] Appl. No.: 8,098

[22] Filed: Jan. 31, 1979

[30] Foreign Application Priority Data

Jan. 31, 1978 [CH] Switzerland ..... 1023/78
Feb. 8, 1978 [CH] Switzerland ..... 1391/78

[51] Int. Cl.[3] ..... B24B 3/30; B24C 3/08
[52] U.S. Cl. ..... 51/423; 51/164.1
[58] Field of Search ..... 51/164.1, 422, 423; 241/153, 176, 177, 178

[56] References Cited

U.S. PATENT DOCUMENTS

| | | | |
|---|---|---|---|
| 1,110,069 | 9/1914 | McLoed | 241/153 X |
| 2,305,451 | 12/1942 | Turnbull | 51/423 |
| 2,359,944 | 10/1944 | Schummer | 51/164.1 |
| 2,574,867 | 11/1951 | Gladfelter | 51/423 |
| 2,885,155 | 5/1959 | Frankert | 241/153 |
| 3,896,863 | 7/1975 | Smiltneek | 241/178 X |

FOREIGN PATENT DOCUMENTS

| | | | |
|---|---|---|---|
| 109648 | 4/1900 | Fed. Rep. of Germany | 51/422 |
| 351183 | 4/1922 | Fed. Rep. of Germany | 51/422 |
| 2424086 | 11/1975 | Fed. Rep. of Germany | 51/422 |
| 416545 | 5/1910 | France | 241/177 |
| 13444 | of 1898 | United Kingdom | 51/422 |

*Primary Examiner*—Gary L. Smith
*Attorney, Agent, or Firm*—Roylance, Abrams, Berdo & Farley

[57] ABSTRACT

A machine for conveying and blast treating workpieces by an abrasive or blasting medium includes at least one rotatable barrel or drum in a blasting chamber, the axis of rotation of the drum being inclined downwardly in the direction of conveyance. The diameter of the drum decreases in the direction of conveyance and a blast wheel is mounted at the upper, larger, input end of the drum. The lowest generatrix of the drum is horizontal or slightly inclined upwardly in the downstream direction. In a preferred embodiment, the drum diameter decreases in stepwise fashion. Axially extending impeller members in the drum provide for uniform travel of the workpieces. In one embodiment, a discharge drum and a housing drum are rotatable with the blasting drum.

25 Claims, 7 Drawing Figures

BARREL-TYPE SHOT BLASTING MACHINE

This invention relates to a continuous barrel-type shot blasting machine for the continuous passage of workpieces through a blasting barrel or drum which is rotatable about an axis inclined downwardly in the direction of passage.

BACKGROUND OF THE INVENTION

A continuous drum blasting machine is known from German Pat. No. 109,648, wherein a cylindrical drum rotates about an axis inclined with respect to the horizontal, the interior of the drum having several longitudinally displaced blast nozzles for the purpose of cleaning and de-burring of workpieces, particularly of cast pieces. Since the workpieces are carried partly by the rotating inside wall of the drum and then dropped back again into the lower area of the drum, and on many occasions slide down along the slanting interior surface of the drum, a completely uncontrollable and uneven movement of passage through the drum and turning of the workpieces results. In the case of variable kinds of workpieces, this leads particularly to a greatly fluctuating throughput with great variation in the amount of blasting to which the workpieces are subjected. If it is desired to efficiently arrange blast wheels within the drum, the diameter of the drum must be selected very large, as a result of which the production costs and the size of the installation, as well as the revolving behavior of the machines, are adversely influenced.

An attempt has been made to achieve a more even conveyance of the workpieces by arrangement of spirals on the inside wall of the drum in the case of horizontal cylindrical drums as shown in U.S. Pat. No. 3,821,866. However, it developed that the workpieces tumble and do not glide along the wall of the drum and therefore the desired uniform conveyance effect does not result. In addition, the sides of individual workpieces tend to be shielded or covered up by the flanks of the spiral with the result that those sides are poorly blasted or not blasted at all. Furthermore, the flanks of the spirals are subjected to considerable wear.

BRIEF DESCRIPTION OF THE INVENTION

An object of the present invention is to provide a simplified continuous drum blasting machine of this type as compared to previously mentioned embodiments and which permits uniform and predeterminable throughput of workpieces on all workpieces with substantially similar uniform blasting effect, and which guarantees the provision of effective blast wheels which are easily serviceable.

Briefly described, the invention includes a continuous drum blasting machine for the continuous passage of workpieces therethrough and concurrent blasting of the workpieces therein with streams of blasting medium including at least one blasting drum rotatable about an inclined axis with respect to the horizontal, the diameter of said at least one blasting drum decreasing in the direction of passage, the apparatus including at least one blast wheel means for projecting blasting medium into the drum, the means for projecting being mounted at the largest diameter end of the drum.

As a result of the embodiment of the drum structure in accordance with the invention, the carrying movement perpendicular to the axis of the drum, and subsequently, a revolving movement of the workpiece taking place in a vertical downwardly direction will be achieved as a result of which an uncontrollable sliding of the workpieces is avoided, leading to uniform feeding of the workpieces. As an advantage, it follows that the dwell time of the workpieces in the blasting space is determinable and reproducible, thus, reducing over or under-blasting of the workpieces in comparison of traditional machines. Furthermore, as a result of the automatic feed and conveyance, automatic emptying of the drum is made possible.

The arrangement of the blast wheel means in accordance with the invention in front of the inlet opening at the largest diameter end of the drum makes possible a simple construction favorable for servicing, even if several drums are disposed in succession and in which the impingement of the medium along the entire length of the interior of the drum jacket causes a continuous change of the impact angle of the blasting medium on the surfaces of the workpiece, thereby increasing the cleaning performance.

As a result of the advantageous disposition of the drum for the workpieces, and of a discharge drum concentrically in the inside of a rotatably driveable housing drum, a disposal of the drum driving mechanism which permits easy servicing is made possible. This considerably decreases the production costs of such a blasting machine by saving of feed screws for the blasting medium and the otherwise additional drive for the discharge drum.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
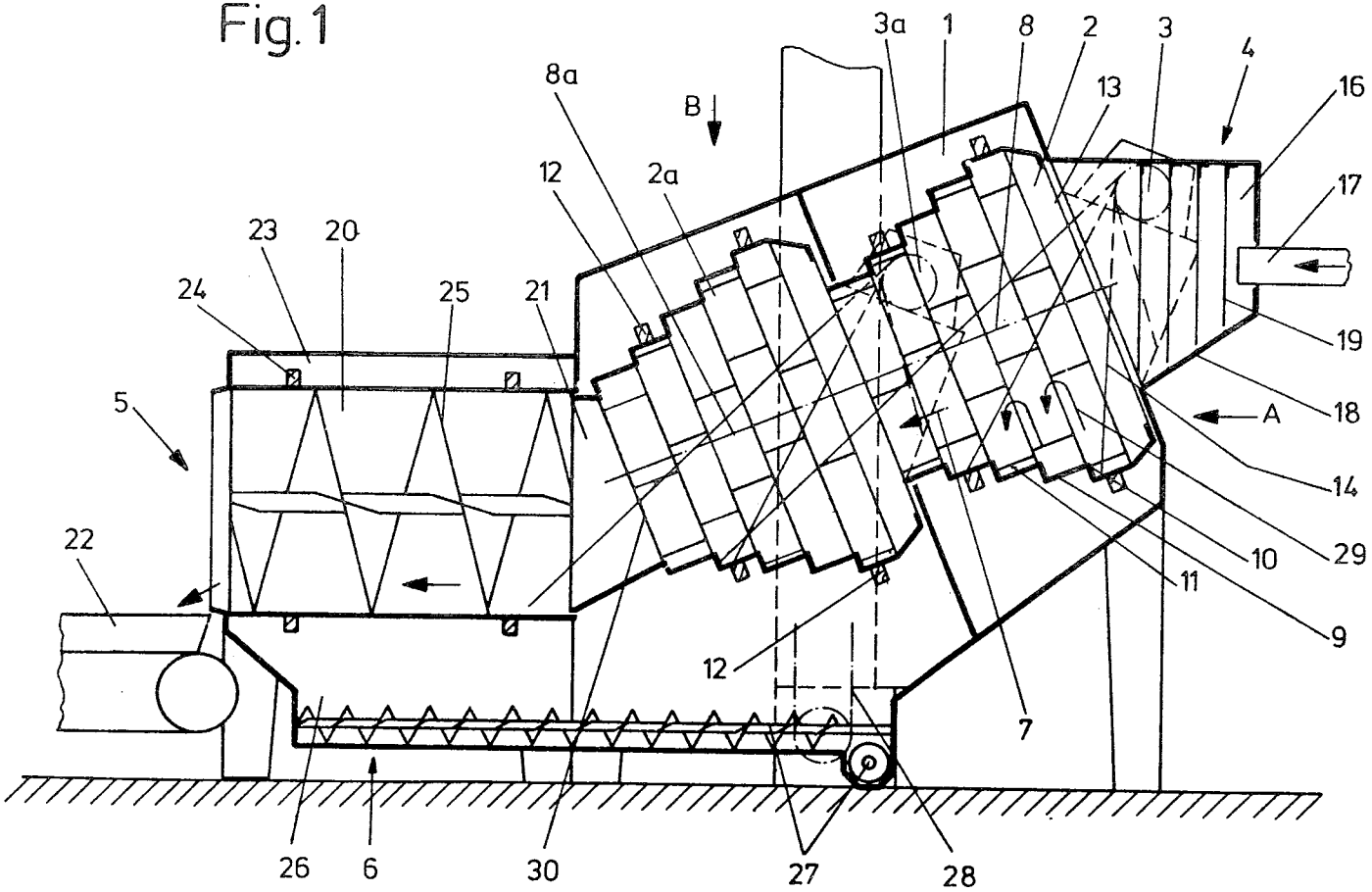
FIG. 1 is a schematic side elevation in longitudinal section through a continuous drum blasting machine.

The continuous drum blasting machine shown in FIG. 1 includes a blasting chamber 1 with drums 2 and 2*a* disposed therein, and blast wheels 3 and 3*a* disposed thereon, a feeding apparatus 4, a discharge apparatus 5, a collecting and return arrangement 6 for the abrasive or blasting medium and the sand. The complete system also includes a blasting medium cleaning or conditioning installation and feed to the blast wheels 3 and 3*a*, not shown in FIG. 1. The blast wheels, as will be recognized by those skilled in the art, can each be a centrifugal propelling apparatus which rotates at a relatively high speed and includes blades for directing blasting medium over a predetermined relatively wide angle as indicated by the lines emanating from the circular symbols depicting the blast wheels 3, 3*a* in FIG. 1.

The two drums 2 and 2a are disposed in succession in the direction of passage 7 of the workpieces to be blasted, i.e., the downstream direction, with the axes 8 and 8a of the drums downwardly inclined with respect to the direction of passage. The diameters of the two drums 2 and 2a decrease intermittently or stepwise in the direction of passage 7, drums 2 and 2a being formed from a plurality of cylindrical portions 9 of various diameters with annular interconnecting members 10 presenting surfaces which extend perpendicular to the cylindrical surfaces of portions 9 and to the axes of rotation.

Figure 7:
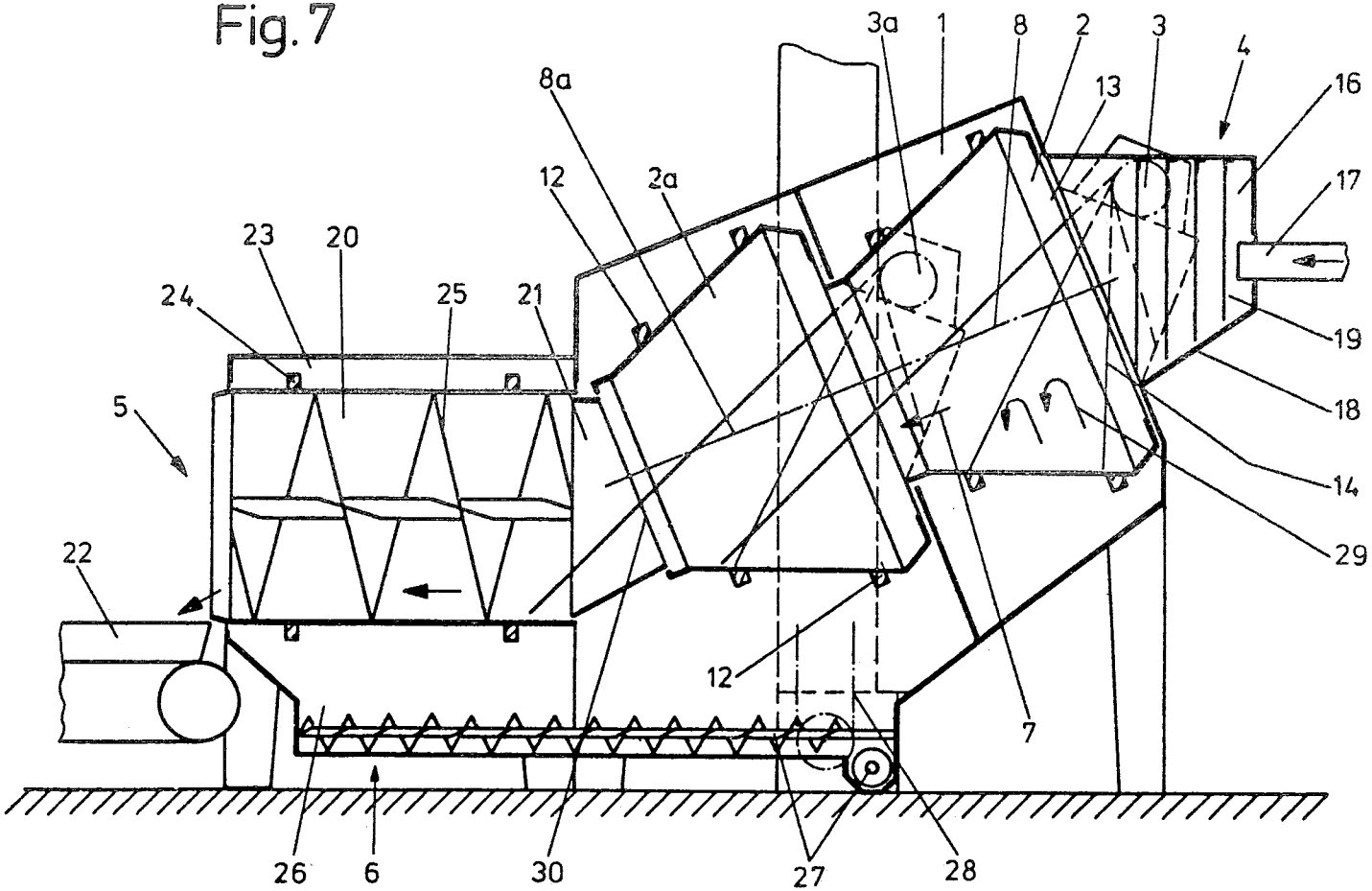
FIG. 7 is a side elevation, similar to FIG. 1, but with the diameter of the drums decreasing continuously.

In the case of a simplified modification of the apparatus, as shown in FIG. 7, the diameters of drums 2 and 2a can be formed to continuously decrease in the downstream direction with the result that each drum is developed in the form of a truncated cone.

In the case of the two variations of the apparatus, the inclination of the axes 8 and 8a is preferably selected in such a way that the lowest point of the largest diameter of each of the drums lies at the same height as, or slightly lower than, the lowest point of the smallest diameter thereof.

On the inside periphery of the drum is provided driving crosspieces or bridges 11 which extend in a direction parallel with the direction of passage 7, the cross pieces extending radially inwardly from the inner walls of the drums and attached in displaced positions in axial and circular directions along the individual portions 9. The drums 2 and 2a are mounted on rollers 12, individual ones of which can be driven by means of a conventional drive, not illustrated, as a result of which the drums are made to rotate. Advantageously, each of the drums 2 and 2 can be driven individually so that variable rotational speeds and/or different directions of rotation can also be selected.

Figure 2:
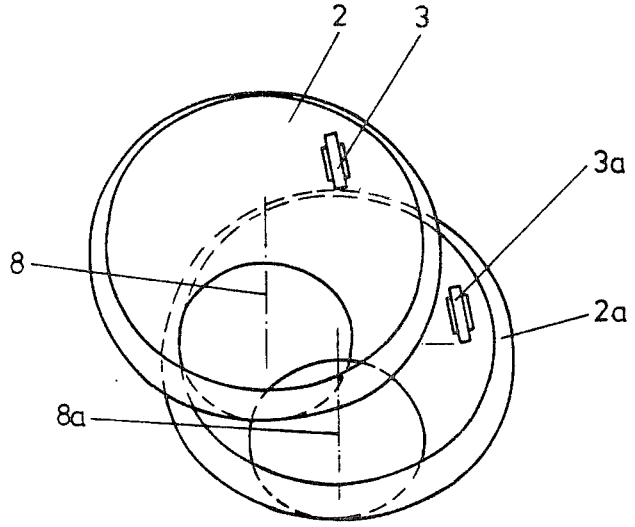
FIG. 2 is a partial end elevation of the apparatus of FIG. 1 in the direction of arrow A.
Figure 3:
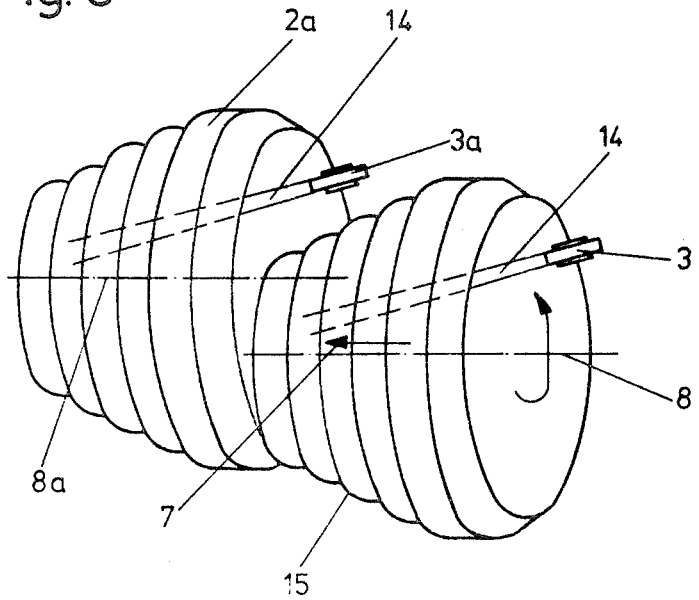
FIG. 3 is a partial plan view of the drum structure of FIGS. 1 and 2 in the direction of arrow B.

As can be seen from FIGS. 2 and 3, the axes 8 and 8a of the two drums 2 and 2a, respectively, are disposed at the same inclination but are laterally displaced from each other.

The blast wheels 3 and 3a are attached to the wall of the blasting chamber in front of or directly in the area of the inlet area 13 which is at the end of the drums 2 and 2a which has the largest diameter, the blast wheels being disposed such that the fan-like angle 14 of the projected material encompasses the entire jacket length 15 of the drums. This arrangement is considerably facilitated, especially in the case of the second drum 2a, by its lateral displacement by which also the accessibility of the blast wheels 3 and 3a is ensured for the purpose of replacing worn-out parts.

The feed arrangement 4 is disposed in front of the inlet opening 13 of the first drum 2, which apparatus includes an input chamber 16 attached to the blasting chamber 1 and a feeding arrangement 17 which can be, for example, a vibrating chute or a conveyor belt. The bottom of the feed-in chamber 16 is formed as a chute 18 and, for the purpose of sealing it from the outside, elastic curtains 19, made, for example, of rubber, are attached in chamber 16.

The discharge apparatus 5 includes a cylindrical discharge drum 20 having its axis disposed horizontally, of a funnel 21 disposed fixedly between the discharge drum 20 and the outlet opening 30 of the second drum 2a, and of a conveyor belt 22 which follows the discharge drum 20. The discharge drum 20 is mounted driveably on rollers 24 in a chamber 23 and has on its inside a screw conveyor 25 which extends up to the center, resulting in the formation of a labyrinth-like seal of the blasting chamber 1 from the outside at the outlet end.

The blasting drums 2 and 2a and the discharge drum 20 are preferably permeable about their peripheries by the use of perforated metal sheets so that the mixture of blasting agent, sand and blasted-off particles can pass therethrough and drop into a collecting chamber 26 of the collecting and return arrangement 6 which is disposed beneath the previously described apparatus. In this arrangement, the mixture is fed by means of two screw conveyors 27 to an elevator 28 which transports it to a blasting agent treatment facility, not illustrated in detail.

The method of operation of the continuous drum blasting machine described is as follows. The workpieces to be blasted are fed continuously by means of the feeding arrangement 17 and chute 18 through the inlet opening 13 of first drum 2 where the first blast treatment takes place by the blast wheel 3. As a result of the rotation of the drum 2, the workpieces are carried by the parts 9 perpendicularly with respect to the slantingly positioned axis 8 by friction or by the bridges 11 as shown by the arrows 29. As soon as the friction has been overcome and/or the bridges 11 are no longer effective, the workpieces drop and tumble in a manner indicated by arrows 29 perpendicularly downwardly, so that at the same time they reach the next following portion 9. Thus, the workpieces migrate through the drum 2 to step-to-step as a result of which an automatic feed movement develops with a simultaneous rotation of the workpieces. The step-like development of the drum thus prevents an uncontrollable migration of the workpieces.

In the case of the variation of the apparatus having a truncated cone-shaped drum, the same driver and forward movement of the workpieces takes place because of the slanting axis and the conical drum wherein the lower generatrix of the drum is established to be slightly rising in the direction of passage 7, preventing an uncontrolled forward movement as might take place by sliding.

In the succeeding drum 2a, a repeated blasting of the workpieces by means of the blast wheel 3a takes place, as described, with the same forward and rotating movement. The transfer of the workpieces is accomplished directly from the first into the second drum since an overlapping of the drums as a result of the conical shape can easily be achieved.

Subsequently, the workpieces are fed through the fixed funnel 21 to the discharge drum 20 where the workpieces are removed from the drum structure in a known manner. The discharge drum 20 delivers the cleaned workpieces to the conveyor belt 22 by which they are transported to their next use.

In addition to the embodiment described herein with two drums, the use of only one drum is also possible in the case of a lower rate of production of workpieces. The number of drums is to be determined depending on the time of passage and the time of blast, and it is also possible for more than two drums to be used.

Figure 4:
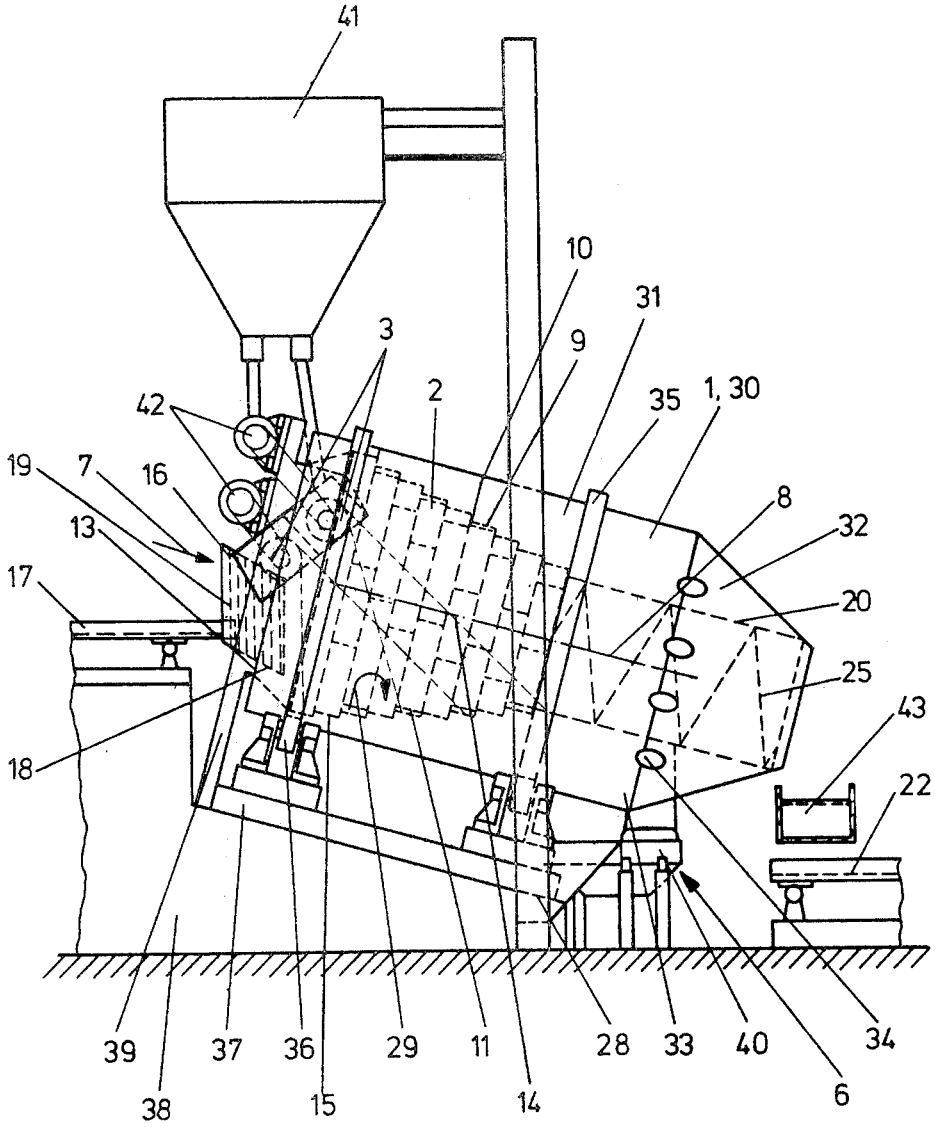
FIG. 4 is a side elevation of a second embodiment of a continuous drum blasting machine according to the invention.

A further embodiment of an apparatus in accordance with the invention is shown in FIG. 4 wherein the blasting machine has a chamber 1 formed as a rotating housing drum 30, the axis 8 of which is inclined downwardly in the downstream direction of the workpieces to be treated.

The housing drum 30 includes a cylindrical portion 31 and a portion 32 at the downstream end thereof. A collecting zone 33 for the mixture of blasting agent, sand and blasted-off particles develops in the area of the junction of the two portions 31 and 32 as a result of the smaller end of the truncated cone-shaped or frustoconical part 32 lying higher, as viewed in the direction of passage 7, than the outlet end of cylindrical portion 31. The jacket of housing drum 30 is provided with means defining apertures 34 for the passage of the mixture in the peripheral area of this collecting region 33. Cylindrical portion 31 has two bearing rings 35 by means of which the housing drum is mounted on rollers 36, individual ones of which can be driven by means of a drive, not shown, causing the drum 30 to rotate. Rollers 36 are attached to a frame 37 which is mounted on a foundation 38 having a slanting surface. In drum 30, a drum 2 for the workpieces to be blasted and a discharge drum 20 are disposed concentrically with respect to the housing drum so that all three drums can be made to rotate together in the same direction about the slanting axis 8, the drums being mutually fixedly interconnected.

As has already been described in connection with FIG. 1, the diameter of drum 2 decreases step-by-step in the downstream direction, the cylindrical portions 9 being equipped with bridge members 11 attached to the inside wall and annular surfaces 10 running perpendicularly and interconnecting adjacent ones of the portions 9.

The discharge drum 20, which is preferably cylindrical, directly follows blasting drum 2, the discharge drum having a screw conveyor 25 in the inside extending along the center thereof, as a result of which a labyrinth-like seal is developed with respect to the outlet side of drum 2.

Figure 5:
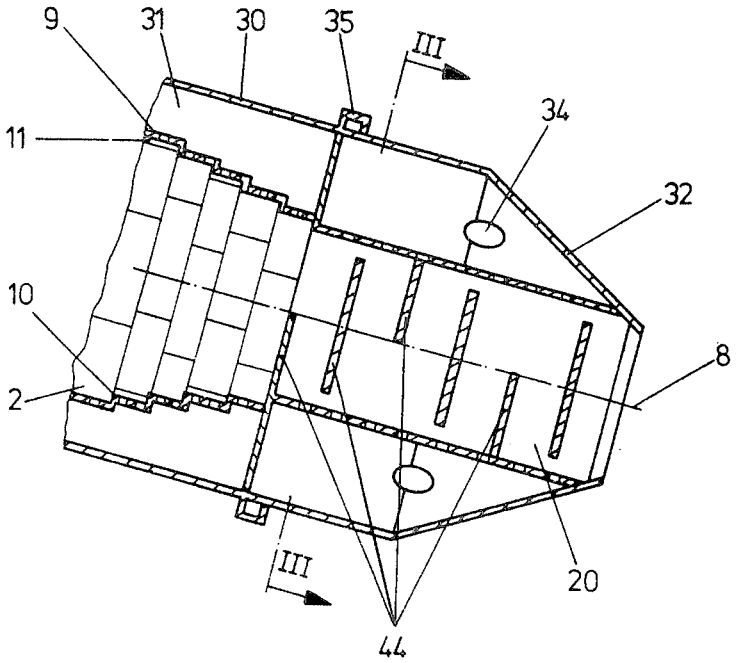
FIG. 5 shows an enlarged partial side elevation in longitudinal section along the axis 8 of an apparatus similar to FIG. 4 showing a further embodiment of the discharge drum 20.
Figure 6:
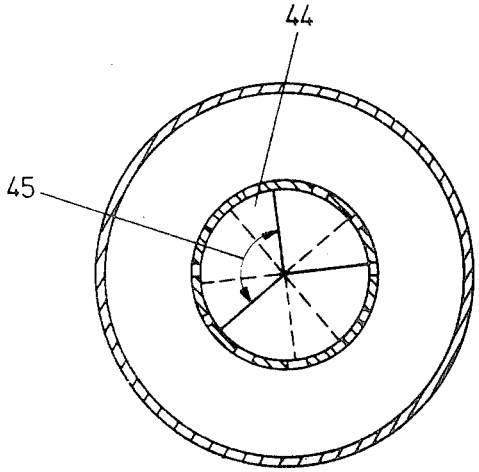
FIG. 6 is a sectional view along line III—III of FIG. 5.

A further embodiment of the discharge drum 20 is shown in FIGS. 5 and 6, this embodiment being provided with sector-shaped metal plates 44 which are attached to the inside wall of the drum, these plates being axially spaced apart and circularly displaced with respect to each other. The size and arrangement of the sector-shaped metal plates 44 is selected such that, again, a labyrinth-like seal develops between the inlet and outlet ends of the discharge drum. In the specific embodiment shown by way of example, the metal plates 44 each have a sector angle 45 of 120°.

Blasting drum 2 and discharge drum 20 are again formed so as to be peripherally permeable as a result of the use of perforated metal sheets so that the mixture of blasting agent, sand and blasted-off particles can pass therethrough so that the mixture slides in the inside of housing drum 30 to the collecting zone 33. A collecting and return transportion arrangement 6 includes a chute or vibrating chute 40 and an elevator 28 conveys the mixture to a blasting agent treatment facility 41. On a holding arrangement 39 fixedly attached to frame 37, two blast wheels 3 with their driving motors 42, as well as a feed-in chamber 16, are attached. The bottom of the feed-in chamber 16 is formed as a chute 18 and, to provide a seal against material passing to the outside, elastic curtains 19 which can be made of rubber are suspended in the feed-in chamber 16. In front of the feed-in chamber a feed-in arrangement 17, for example, a vibration chute, are disposed on the foundation 38. The two blast wheels 3 are disposed in such a way in the area of the inlet opening 13 of the blasting drum 2 that the fan-shaped blasting trajectories jointly cover the entire inside length of the jacket 15 of drum 2.

At the discharge end of the housing drum 30, there is a chute 43 which feeds the blasted workpieces to a conveyor belt or a vibrating chute 22. Whenever two continuous drum blasting machines are set up in parallel, one beside the other, it is possible to feed one vibration chute or one conveyor belt 22 with two chutes 43.

The method of operation of the embodiment according to FIGS. 4–6 corresponds to that described in connection with the embodiment of FIG. 1.

It is also possible to permit the illustrated arrangement of the blasting and discharge drum to rotate within a fixed housing chamber, in which case the bottom of the chamber is developed such that the mixture slides to a collecting tank from which it is fed by means of a chute-type channel to the elevator. In this case, a means of transportation such as the screw conveyors can be omitted.

FIG. 7 shows an embodiment similar to FIG. 1 wherein the drums are formed with walls which continuously decrease in diameter. Reference numerals similar to those of FIG. 1 are used therein.

The centrifugal blasting machine according to the invention is suitable for all workpieces which can be handled in a drum and it can be used advantageously in connection with an automatic molding and casting installation. Since experiments have shown that the uniform conveying effect of such a blasting machine is largely independent of the degree of filling of the drum, the apparatus can easily be adapted in the rate of throughput of the machine to the related production rate of an automatic molding and casting installation, as a result of which intermediate storage can be avoided.

While certain advantageous embodiments have been chosen to illustrate the invention, it will be understood by those skilled in the art that various changes and modifications can be made therein without departing from the scope of the invention as defined in the appended claims.

What is claimed is:

1. A continuous drum blasting machine for the continuous passage of workpieces therethrough and concurrent blasting of the workpieces therein with streams of blasting medium, comprising at least one blasting drum rotatable about an axis inclined with respect to the horizontal, the diameter of said at least one blasting drum decreasing in the direction of passage to provide larger and smaller diameter ends;

at least one blast wheel means for projecting blasting medium into said drum, said blast wheel means being mounted at said larger diameter end of said drum;

a discharge drum fixedly attached to said smaller diameter end of said blasting drum for rotation therewith; and a housing drum enclosing said blasting and discharge drums.

2. A machine according to claim 1 wherein said diameter of said drum decreases intermittently.

3. A machine according to claim 2 wherein said at least one drum includes a plurality of cylindrical portions of different diameters, and a plurality of interconnecting annular members having surfaces perpendicular to said cylindrical portions.

4. A machine according to claim 3 wherein each of said cylindrical portions includes a plurality of axially extending cross pieces mounted on the inner surface thereof.

5. A machine according to claim 2 and including a plurality of axially extending driving cross pieces on the interior surface of said drum.

6. A machine according to claim 1 wherein said diameter of said drum decreases continuously.

7. A machine according to claim 1 wherein the axis of rotation of said drum is inclined such that the lowest point of the greatest diameter of the drum is no higher than the lowest point of the smallest diameter of the drum.

8. A machine according to claim 1 wherein said at least one blast wheel means is arranged to project blasting medium along the entire inside length of said drum.

9. A machine according to claim 1 wherein said housing drum is supported concentrically with said blasting drum for rotation therewith.

10. A machine according to claim 1 wherein said housing drum includes a substantially cylindrical portion and a frustoconical portion at the downstream end of said cylindrical portion, said frustoconical portion decreasing in diameter in the downstream direction.

11. A machine according to either of claims 1 or 10 wherein said housing drum includes a peripheral area defining a plurality of apertures therethrough said area intersecting the lower end thereof.

12. A machine according to claim 11 and further comprising means for conditioning used blasting medium; and means disposed below said apertures for receiving blasting medium emerging therefrom and for returning said medium to said conditioning means.

13. A machine according to claim 1 and including means for mounting said at least one blast wheel means adjacent the upper end of said housing drum.

14. A machine according to claim 1 wherein said blasting and discharge drum are formed from perforated sheet metal.

15. A machine according to claim 1 wherein said discharge drum includes a plurality of sector-shaped sheet metal members extending radially inwardly from the inner surface thereof, said members being axially separated and circularly offset from each other.

16. A machine according to claim 1 wherein said discharge drum includes a screw conveyor having a central axis extending along the axis of rotation of said drums.

17. A continuous drum blasting machine for the continuous passage of workpieces therethrough and concurrent blasting of the workpieces therein with streams of blasting medium, comprising at least two drums, each of said drums having a diameter which decreases in the direction of passage to provide larger and smaller diameter ends thereof, said drums being mounted for rotation about separate, parallel axes which are inclined with respect to the horizontal and which are laterally separated from each other; and at least one blast wheel means for projecting blasting medium into each said drum, one of said blast wheel means being mounted at said larger diameter end of each said drum.

18. A machine according to claim 17, wherein said diameter of each said drum decreases intermittently.

19. A machine according to claim 18, wherein each said drum includes a plurality of cylindrical portions of different diameters, and a plurality of interconnecting annular members having surfaces perpendicular to said cylindrical portions.

20. A machine according to claim 19, wherein each of said cylindrical portions includes a plurality of axially extending cross pieces mounted on the inner surface thereof.

21. A machine according to claim 18, and including a plurality of axially extending cross pieces mounted on the interior surface of each said drum.

22. A machine according to claim 17, wherein said diameter of each said drum decreases continuously.

23. A machine according to claim 17, wherein the axis of rotation of each said drum is inclined such that the lowest point of said larger diameter end of each said drum is no higher than the lowest point of said smaller diameter end thereof.

24. A machine according to claim 17, wherein each said blast wheel means is arranged to project blasting medium along the entire inside length of the respective drum.

25. A machine according to claim 17 wherein said blast wheel means for each of said drums is mounted above and laterally offset from the axis of rotation of the respective drum.

* * * * *